US011264694B2

(12) United States Patent
Enano

(10) Patent No.: US 11,264,694 B2
(45) Date of Patent: Mar. 1, 2022

(54) SATELLITE SIGNAL ACQUIRING APPARATUS AND METHOD

(71) Applicants: Kabushiki Kaisha Toshiba, Tokyo (JP); Toshiba Infrastructure Systems & Solutions Corporation, Kawasaki (JP)

(72) Inventor: Mikhail Cordero Enano, Tokyo (JP)

(73) Assignees: Kabushiki Kaisha Toshiba, Tokyo (JP); Toshiba Infrastructure Systems & Solutions Corporation, Kawasaki (JP)

( * ) Notice: Subject to any disclaimer, the term of this patent is extended or adjusted under 35 U.S.C. 154(b) by 0 days.

(21) Appl. No.: 17/122,125

(22) Filed: Dec. 15, 2020

(65) Prior Publication Data

US 2021/0184349 A1 Jun. 17, 2021

(30) Foreign Application Priority Data

Dec. 16, 2019 (JP) ..... JP2019-226457
Oct. 12, 2020 (JP) ..... JP2020-172081

(51) Int. Cl.
*H01Q 3/02* (2006.01)
*H01Q 1/12* (2006.01)

(52) U.S. Cl.
CPC ..... *H01Q 1/1257* (2013.01)

(58) Field of Classification Search
CPC ..... H01Q 1/1257; H01Q 1/18; H01Q 1/24; H01Q 3/08; H01Q 3/005; H01Q 3/242
See application file for complete search history.

(56) References Cited

U.S. PATENT DOCUMENTS 5,422,648 A 6/1995 Uematsu et al.
6,259,415 B1 * 7/2001 Kumpfbeck ..... H01Q 3/08 343/765
2007/0001920 A1 * 1/2007 Webb ..... H01Q 1/42 343/766
2012/0068899 A1 * 3/2012 Ayotte ..... H01Q 1/1235 343/766
2018/0316089 A1 11/2018 Amaki et al.

FOREIGN PATENT DOCUMENTS

JP H06-097721 A 4/1994
JP 11-14729 A 1/1999
JP 2013-243655 A 12/2013
JP 2018-189440 A 11/2018

* cited by examiner

*Primary Examiner* — Awat M Salih
(74) *Attorney, Agent, or Firm* — Baker Botts L.L.P.

(57) ABSTRACT

A satellite signal acquiring apparatus includes antenna, azimuth motor, elevation motor, main body, inclination sensor and processor. Antenna receives radio wave from a communication satellite. Azimuth motor rotates the antenna in azimuth angle direction. Elevation motor changes elevation angle of the antenna. Main body is equipped with the antenna, the azimuth motor, and the elevation motor. Inclination sensor obtains inclination information of the main body. Processor corrects the elevation angle based on inclination information to hold the elevation angle of the antenna in an earth coordinate system constant regardless of an azimuth angle of the antenna. Processor acquires the communication satellite signal based on reception intensity of the radio wave.

8 Claims, 17 Drawing Sheets

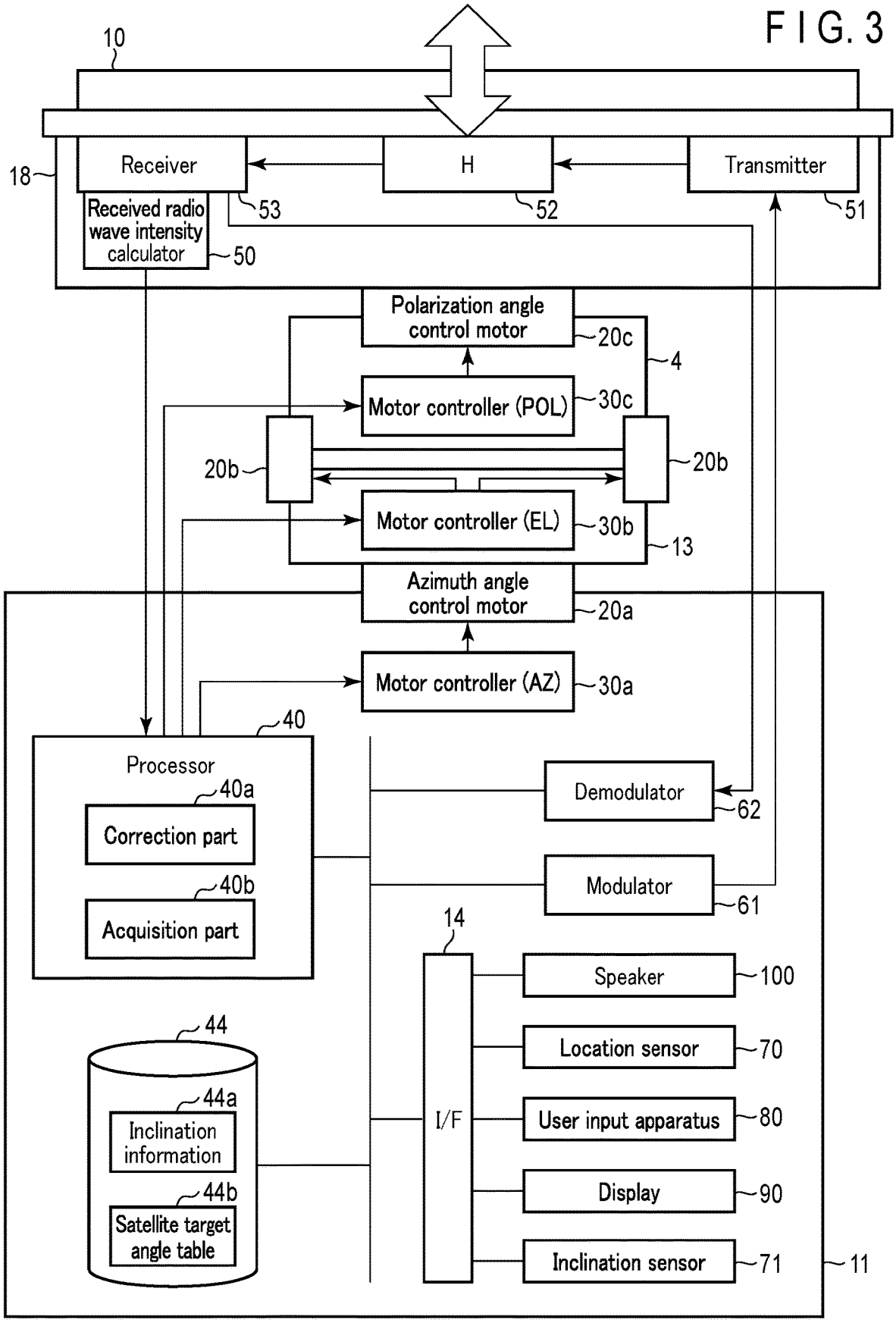
FIG. 3
10
18
Receiver
H
Transmitter
Received radio wave intensity calculator
50
53
52
51
Polarization angle control motor
20c
4
Motor controller (POL)
30c
20b
20b
Motor controller (EL)
30b
13
Azimuth angle control motor
20a
Motor controller (AZ)
30a
40
Processor
40a
Correction part
40b
Acquisition part
Demodulator
62
Modulator
61
14
Speaker
100
44
Location sensor
70
44a
Inclination information
I/F
User input apparatus
80
44b
Satellite target angle table
Display
90
Inclination sensor
71
11

---------- Perpendicular to horizontal line = vertical axis, horizontal line = horizontal axis —·-———·-— Vertical axis and horizontal axis of apparatus ---------- Perpendicular to horizontal line = vertical axis, horizontal line = horizontal axis —·——··— Vertical axis and horizontal axis of apparatus ---------- Perpendicular to horizontal line = vertical axis, horizontal line = horizontal axis —·——··— Vertical axis and horizontal axis of apparatus

| $AZ_{VSAT}$ | $EL_{VSAT}$ |
|---|---|
| 0° | $EL'_{SAT} - I_x$ |
| 90° | $EL'_{SAT} - I_y$ |
| 180° | $EL'_{SAT} + I_x$ |
| −90° | $EL'_{SAT} + I_y$ |

| Point | $AZ_{VSAT}$ |
|---|---|
| First point | $\tan^{-1}\frac{I_y}{I_x}$ |
| Second point | $\tan^{-1}\frac{I_y}{I_x} + 30°$ |
| Third point | $\tan^{-1}\frac{I_y}{I_x} + 150°$ |
| Fourth point | $\tan^{-1}\frac{I_y}{I_x} - 30°$ |
| Fifth point | $\tan^{-1}\frac{I_y}{I_x} - 150°$ |
| Sixth point | $\tan^{-1}\frac{I_y}{I_x} - 180°$ |

F I G. 15

SATELLITE SIGNAL ACQUIRING APPARATUS AND METHOD

This application is based upon and claims the benefit of priority from Japanese Patent Applications No. 2019-226457, filed Dec. 16, 2019 and No. 2020-172081, filed Oct. 12, 2020, the entire contents of which are incorporated herein by reference.

FIELD

Embodiments described herein relate generally to a satellite signal acquiring apparatus and method.

BACKGROUND

A very small aperture terminal (VSAT) is known as a satellite communication apparatus having a relatively small antenna aperture among communication apparatuses for communicating with a geostationary satellite. For example, a VSAT apparatus that is small enough to be mounted on a vehicle or carried by one person is also available. Taking advantage of its mobility, the VSAT has been brought into use at disaster sites, etc. The VSAT is also often used in cooperation with mobile communication infrastructure.

For communication with a satellite, it is necessary to accurately acquire the satellite (or a satellite signal) and properly orient an antenna surface toward the satellite. Since properly orienting an antenna toward a satellite by hand requires human skills, an automatic acquisition function of a satellite signal has been developed.

A VSAT apparatus having an automatic acquisition function based on an azimuth sensor will not be able to detect an azimuth of a communication satellite if the azimuth sensor fails. In addition, since the azimuth sensor detects an azimuth by magnetic force, if there is a disturbance in ambient magnetic field, an error in the detected azimuth becomes large. Not implementing an azimuth sensor in future apparatuses is also being considered, and a technique capable of securely acquiring a satellite in a short time without resort to an azimuth sensor is desired.

BRIEF DESCRIPTION OF THE DRAWINGS

FIG. 3 is a functional block diagram showing an example of a satellite signal acquiring apparatus according to the embodiment;

FIG. 15 is a diagram showing a table representing calculating expressions of six points to be sampled;

DETAILED DESCRIPTION

In general, according to one embodiment, a satellite signal acquiring apparatus includes an antenna, an azimuth angle control motor, an elevation angle control motor, a main body equipped with the antenna, the azimuth angle control motor, and the elevation angle control motor, an inclination sensor configured to obtain inclination information of the main body and at least one processor. The antenna receives a radio wave from a communication satellite. The azimuth angle control motor rotates the antenna in an azimuth angle direction in an acquiring mode acquiring the communication satellite signal. The elevation angle control motor changes an elevation angle of the antenna. The main body is equipped with the antenna, the azimuth angle control motor, and the elevation angle control motor. The inclination sensor obtains inclination information of the main body. The processor corrects the elevation angle based on the inclination information to hold the elevation angle of the antenna in an earth coordinate system constant regardless of an azimuth angle of the antenna. The processor acquires the communication satellite signal based on reception intensity of the radio wave in the acquiring mode.

A satellite communication system includes a plurality of earth stations communicating with each other via a satellite on a stationary orbit. This type of system is applicable to, for example, a disaster prevention system in a large municipal area, such as a prefecture. For example, a live video from a satellite communication apparatus provided in a disaster site, etc. can be transmitted to an earth station located in a prefectural capital, etc. through a satellite network. Thereby, a disaster situation can be known immediately and accurately. It is also possible to hold a VoIP (Voice over IP) telephone conversation or a TV conference using a satellite network, and such a system is also applicable to information sharing and disaster countermeasure consultation between interested departments.

Figure 1:
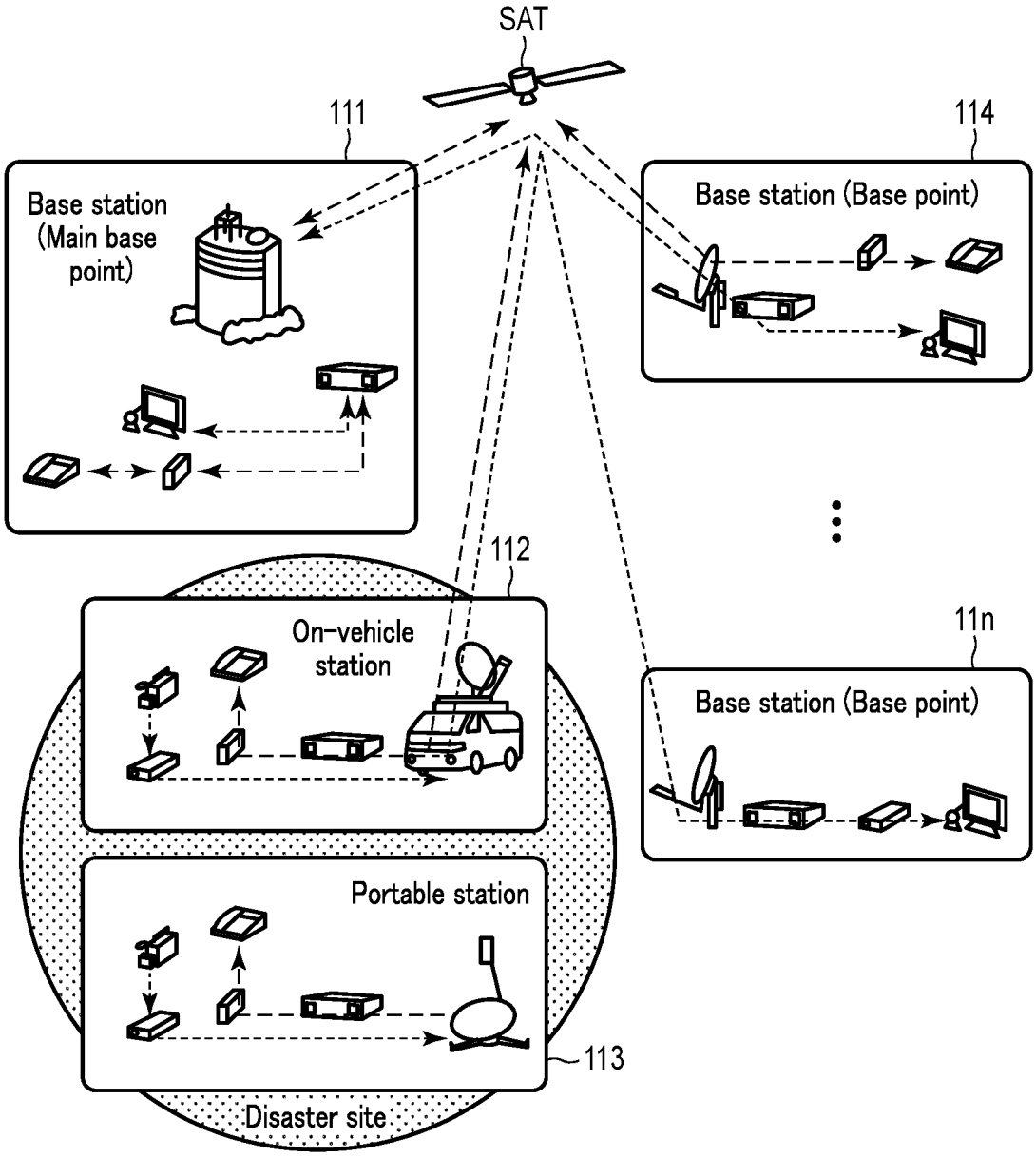
FIG. 1 is a diagram showing an example of a satellite communication system according to an embodiment.

FIG. 1 is a diagram showing an example of a satellite communication system using VSATs. This system is formed of a communication satellite SAT on a stationary orbit as a core. In a case where the system of the present embodiment is applied to a prefectural disaster prevention system, base stations 111 and 114 to 11*n* are installed at a prefectural capital, etc. on the ground side, and an on-vehicle station 112 or a portable station 113 is installed at a disaster site, etc. The base stations 111 and 114 to 11*n*, on-vehicle station 112, and portable station 113 each comprise a VSAT apparatus, which is a micro satellite communication apparatus, and can communicate with one another via the communication satellite SAT.

For example, it is possible for the on-vehicle station 112 or the portable station 113 to transmit a video of the disaster site to a main base point (the base station 111) and respective base points (the base stations 114 to 11*n*) over a satellite network to be used for grasping the disaster situation. The system can also be used for information sharing and disaster countermeasure consultation between interested departments by a VoIP (Voice over IP) telephone conversation or a TV conference using a satellite network.

This type of system is often established as one of the disaster prevention systems for a municipal area. For example, a Demand Assignment Multiple Access (DANA) is applied to a channel assignment scheme for a VSAT apparatus. The DANA is a channel setting scheme in which a requester requests a control station to set a communication channel when necessary and receives resource allocation. Control stations located at some spots on the ground take control of the DANA.

Figure 2:
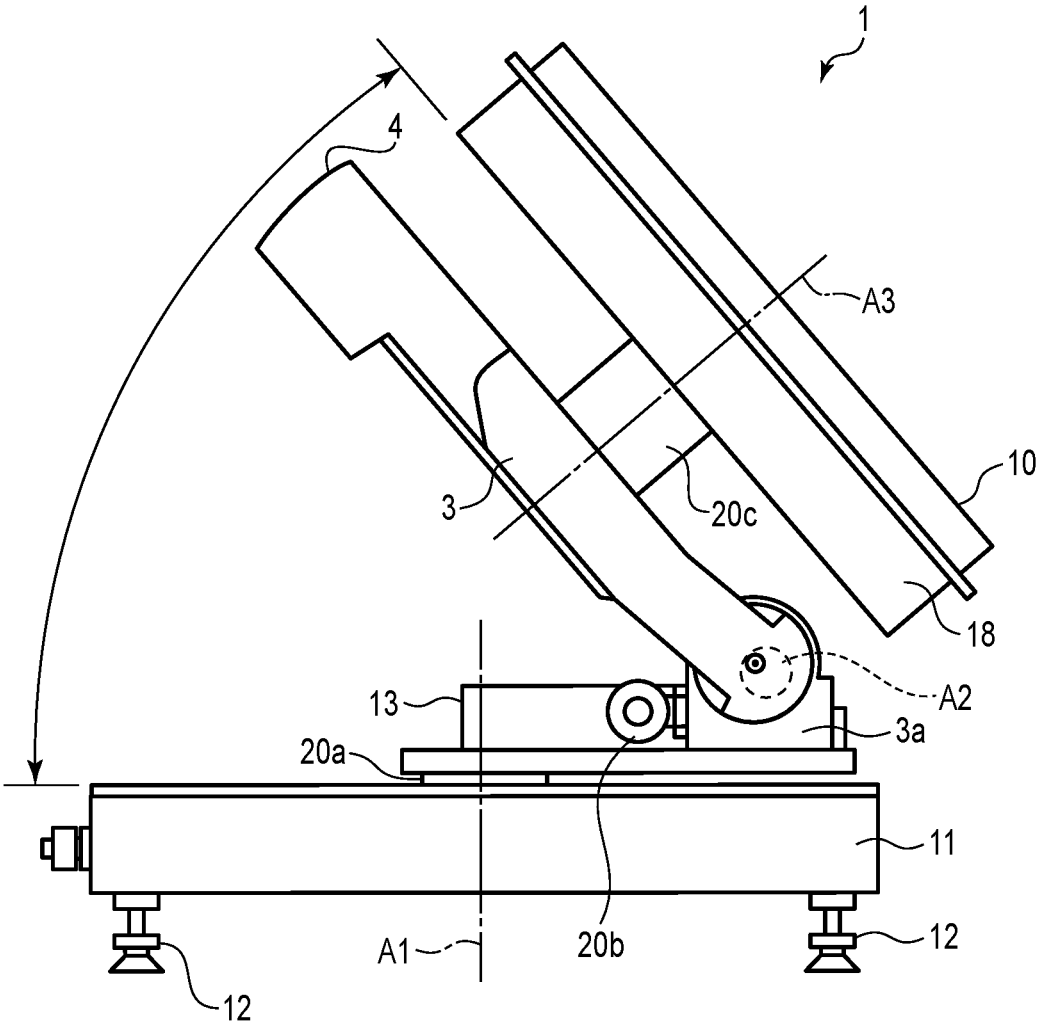
FIG. 2 is a side view of a satellite communication apparatus according to the embodiment.

FIG. 2 is a side view of the satellite communication apparatus according to the embodiment. The satellite communication apparatus 1 shown in FIG. 2 is a so-called VSAT apparatus, and has a function as a satellite signal acquiring apparatus. The size of the satellite communication apparatus 1 is sufficiently compact that a user can carry it, and the weight thereof is also limited. This satellite communication apparatus 1 can be brought to a disaster site, for example, to be utilized as an emergency communication station.

The satellite communication apparatus 1 shown in FIG. 2 includes a main body 11, supporting legs 12 supporting the main body 11, a motor unit (MU) 13, a supporting column 3, a control unit 4, and an antenna 10. In order to minimize energy loss of transmitted and received radio waves, the directivity of the antenna 10 is precisely designed. Thus, in order to acquire a communication satellite (signal), it is necessary to accurately adjust an azimuth angle (AZ), an elevation angle (EL), and a polarization angle (POL) to the communication satellite, which are three axes that are mutually different.

The main body 11 is a so-called embedded-type computer comprising a processor (Central Processing Unit (CPU), Micro Processing Unit (MPU), etc.) and a memory. The main body 11 is a rectangular unit.

The main body 11 includes in an inner side thereof an azimuth angle control motor 20*a* that controls an azimuth angle for satellite acquisition. The azimuth angle control motor 20*a* is controlled by an azimuth angle motor controller (AZ) 30*a* (see FIG. 3), and controls an azimuth angle of the antenna 10. The azimuth angle control motor 20*a* rotates a motor unit 13 in a horizontal direction around a rotation axis A1 (an azimuth axis or an AZ axis) in an acquiring mode.

The motor unit 13 is provided on an upper surface of the main body 11. The motor unit 13 includes an elevation angle control motor 20*b* that operates the antenna 10 in an elevation angle direction in the acquiring mode. The elevation angle control motor 20*b* is controlled by an elevation angle motor controller (EL) 30*b* (see FIG. 3), and controls the elevation angle of the antenna 10. That is, the elevation angle control motor 20*b* moves the supporting column 3 vertically relative to the upper surface of the main body 11 around a rotation axis A2. The supporting column 3 supports side surfaces of the control unit 4 from both sides, and moves integrally with the control unit 4. Thus, the elevation angle of the antenna 10 attached to the control unit 4 is controlled.

The control unit 4 includes a polarization angle control motor 20*c* that controls a polarization angle of the antenna 10 in the acquiring mode. The polarization angle control motor 20*c* is controlled by a polarization angle motor controller (POL) 30*c* (see FIG. 3). The polarization angle control motor 20*c* rotates the antenna 10 around a rotation axis A3 (a polarization axis or a POL axis) together with a signal processor 18 in the acquiring mode.

The antenna 10 receives radio waves from the communication satellite SAT, and transmits radio waves toward the communication satellite SAT. The size of the antenna 10 is, for example, 50 cm×50 cm. Other than the illustrated planar antenna, for example, a parabola antenna can also be used. In addition, the signal processor 18 is provided on a back surface of the antenna 10.

FIG. 3 is a functional block diagram showing an example of the satellite communication apparatus 1 shown in FIG. 2. In FIG. 3, the signal processor 18 provided on the back surface of the antenna 10 includes a transmitter 51, a hybrid circuit 52, a receiver 53, and a received radio wave intensity calculator 50. The transmitter 51 amplifies a transmission signal from the main body 11 to a transmission level, and transmits the transmission signal from the antenna 10 toward the communication satellite SAT via the hybrid circuit 52. The receiver 53 receives, via the hybrid circuit 52, a signal from the communication satellite SAT acquired by the antenna 10, and transmits the obtained reception signal to the main body 11. The received radio wave intensity calculator 50 calculates reception sensitivity of the reception signal received by the antenna 10, and transmits the obtained value to the main body 11.

The main body 11 includes a processor 40, a modulator 61, a demodulator 62, a memory 44, a speaker 100, a location sensor 70, an inclination sensor 71, a user input apparatus 80, and a display 90. Among them, the speaker 100, location sensor 70, user input apparatus 80, display 90, and inclination sensor 71 are connected to an internal bus to the processor 40 via an interface (I/F) 14.

The modulator 61 generates a transmission signal of a radio band, and transmits the transmission signal to the transmitter 51 of the signal processor 18. The demodulator 62 demodulates a reception signal from the signal processor 18 into a baseband signal.

The speaker 100 notifies the user of information related to automatic acquisition control by sound. The location sensor 70 obtains location information (e.g., latitude and longitude) of a location where the satellite communication apparatus 1 is installed by, for example, a global positioning system (GPS). The obtained location information is passed to the processor 40.

The user input apparatus 80 is a user interface for inputting an instruction from a user regarding automatic acquisition control. The user input apparatus 80 includes, for example, a touch panel for selecting an acquisition-targeted satellite, etc.

The display 90 displays information related to automatic acquisition control. For example, a current processing state ("Calibrating", "Acquiring satellite", "Tracking", etc.) may be displayed by LEDs (light emitting diodes). Alternatively, a result of acquiring, for example a successful acquisition or failed acquisition, may be displayed on a liquid crystal panel along with a finish code.

The inclination sensor 71 obtains an inclination amount of the main body 11 (the satellite communication apparatus 1) at an installation location. For example, the inclination amount of the satellite communication apparatus 1 can be obtained by detecting a gravity acceleration of the earth at the installation location using an acceleration sensor. The obtained inclination amount is passed to the processor 40.

The inclination sensor 71 detects information related to the inclination of the satellite communication apparatus 1. The inclination information (the inclination amount, etc.) to be output from the inclination sensor 71 can be used as an index indicating a posture of the satellite communication apparatus 1.

The processor 40 feeds a control signal to the azimuth angle motor controller (AZ) 30*a* to control the azimuth angle of the antenna 10. In addition, the processor 40 feeds a control signal to the elevation angle motor controller (EL) 30*b* to control the elevation angle of the antenna 10. Further, the processor 40 feeds a control signal to the polarization angle motor controller (POL) 30*c* to control the polarization angle of the antenna 10.

The azimuth angle control motor 20*a* and the azimuth angle motor controller (AZ) 30*a* are provided in the main body 11. The elevation angle control motor 20*b* and the elevation angle motor controller (EL) 30*b* are provided in the motor unit 13 (FIG. 2). In addition, the polarization angle control motor 20*c* and the polarization angle motor controller (POL) 30*c* are provided in the control unit 4 (FIG. 2).

The processor 40 includes a correction part 40*a* and an acquisition part 40*b*.

The acquisition part 40*b* acquires the communication satellite SAT based on the radio wave reception intensity in the acquiring mode. The acquisition part 40*b* gives an instruction to each of the azimuth angle motor controller (AZ) 30*a*, elevation angle motor controller (EL) 30*b*, and polarization angle motor controller (POL) 30*c* to control the azimuth angle, elevation angle, and polarization angle of the antenna 10. In addition, the acquisition part 40*b* detects an angle at which the reception intensity of the reception signal is at peak so as to acquire the communication satellite SAT as an acquisition target.

The correction part 40*a* changes the elevation angle of the antenna 10 in tandem with the rotation of the antenna 10 in an azimuth angle direction. At that time, the correction part 40*a* corrects the elevation angle of the antenna 10 with respect to an apparatus coordinate system based on inclination information 44*a* of the satellite communication apparatus 1 that is sensed by the inclination sensor 71. This allows the correction part 40*a* to hold the elevation angle of the antenna 10 in an earth coordinate system constant regardless of the azimuth angle of the antenna 10.

The correction part 40*a* calculates the elevation angle of the antenna 10 that corresponds to the rotation angle of the antenna 10 in the azimuth angle direction based on the inclination information 44*a*. In addition, the correction part 40*a* calculates a rotation speed of the elevation angle control motor 20*b* that corresponds to the calculated elevation angle.

The memory 44 stores the inclination information 44*a* and a satellite target angle table 44*b*. The inclination information 44*a* is inclination information of the main body 11 that is sensed by the inclination sensor 71. The satellite target angle table 44*b* is a table in which location information on the ground (e.g., latitude and longitude) is associated with a satellite target angle (an azimuth angle, an elevation angle, and a polarization angle) of a communication satellite to be acquired. For example, the latitude of Sapporo city, Hokkaido, Japan is 141.4° and the longitude is 43.1°, and a target angle of a satellite A at this position, (an azimuth angle, an elevation angle, and a polarization angle)=(151.2°, 36.1°, 10.4°).

Next, a working effect in the acquisition of the communication satellite SAT will be described.

When the main body 11 is activated, the first satellite acquisition processing is started as the acquiring mode is started so that processing for acquiring the communication satellite SAT using the antenna 10 is started.

Now, an influence of the inclination of the satellite communication apparatus 1 on the satellite acquisition will be described with reference to FIGS. 4A to 4D. In these figures, a vertical direction in a coordinate system (hereinafter, referred to as an earth coordinate system) based on the earth is indicated by the lowercase letter z axis. Further, coordinate axes in a coordinate system (hereinafter, referred to as an apparatus coordinate system) based on the satellite communication apparatus 1 are indicated by the uppercase letter X axis, Y axis, and Z axis. The X axis, Y axis, and Z axis are orthogonal to one another, and among them, the Z axis coincides with the rotation axis A1 (azimuth axis, AZ axis) in FIG. 2. The X axis and the Y axis, for example, coincide with a width direction and a depth direction of the main body 11 (FIG. 2), respectively.

Figure 4A:
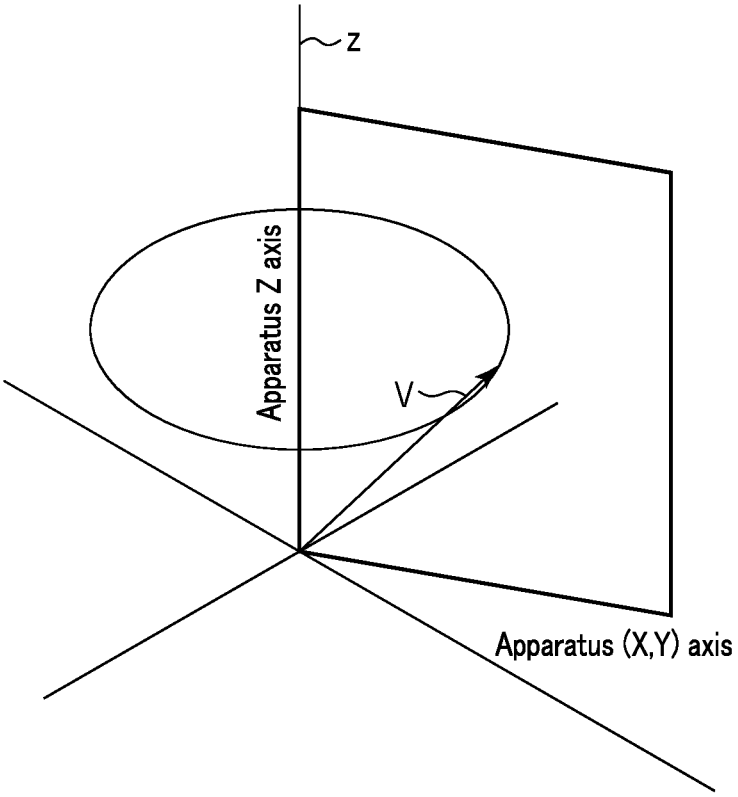
FIG. 4A is a diagram showing a state in which a satellite communication apparatus 1 is installed horizontally.
Figure 4B:
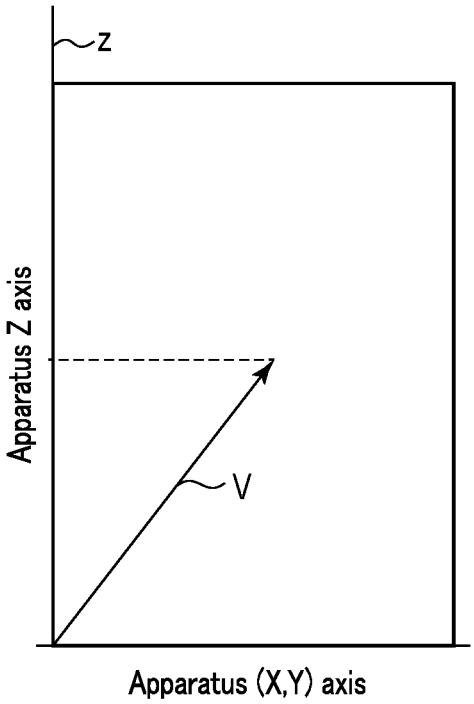
FIG. 4B is a diagram showing that a polarization axis vector V does not fluctuate.

FIG. 4A shows a state in which the satellite communication apparatus 1 is installed horizontally. In this state, the Z axis (hereinafter, referred to as "apparatus coordinate system Z axis") in the apparatus coordinate system and a vertical axis (hereinafter, referred to as "earth coordinate system z axis") in the earth coordinate system overlap each other. In the figure, a sign V indicates a polarization axis (the rotation axis A3 in FIG. 2), and is a vector in a direction perpendicular to the antenna surface (polarization axis vector). When the antenna 10 is rotated 360° around the azimuth axis (the rotation axis A1 in FIG. 2) from the state of FIG. 4A, the polarization axis vector V describes a circle around the apparatus coordinate system Z axis. At this time, since the apparatus coordinate system Z axis and the earth coordinate system z axis coincide with each other, the polarization axis vector V does not fluctuate on a plane with the apparatus coordinate system Z axis as one side, as shown in FIG. 4B.

Figure 4C:
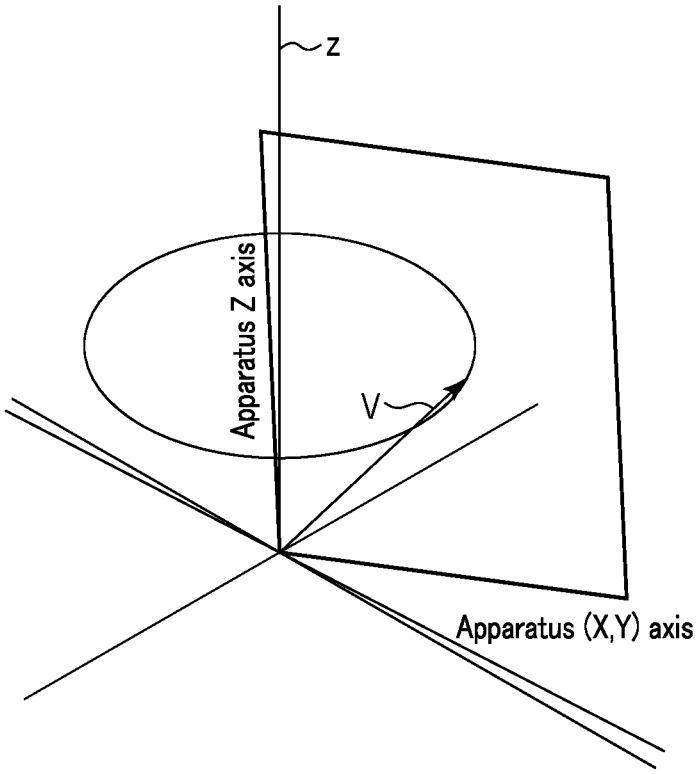
FIG. 4C is a diagram showing a state in which the satellite communication apparatus 1 is installed in an inclined state.
Figure 4D:
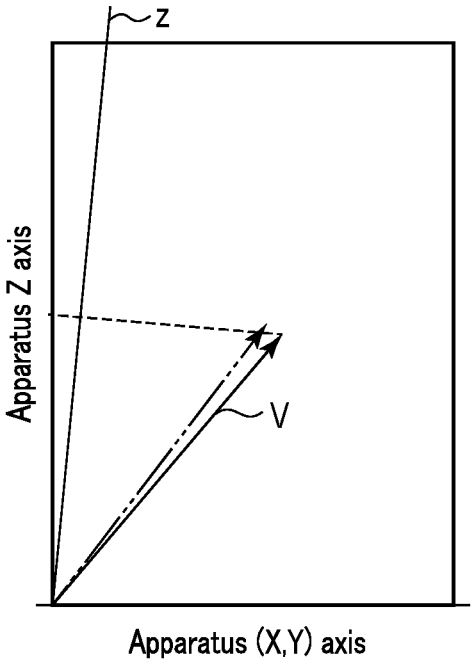
FIG. 4D is a diagram showing that the polarization axis vector V fluctuates.

On the other hand, FIG. 4C shows a state in which the satellite communication apparatus 1 is installed in an inclined state. In this state, the apparatus coordinate system Z axis and the earth coordinate system z axis are out of alignment. When the antenna 10 is rotated 360° around the azimuth axis (the rotation axis A1 in FIG. 2) from this state, the polarization axis vector V describes a circle around the apparatus coordinate system Z axis. However, since the apparatus coordinate system Z axis and the earth coordinate system z axis are out of alignment, the polarization axis vector V fluctuates on a plane with the apparatus Z axis as one side, as shown in FIG. 4D (the double-dotted chain line in the figure).

Figure 5:
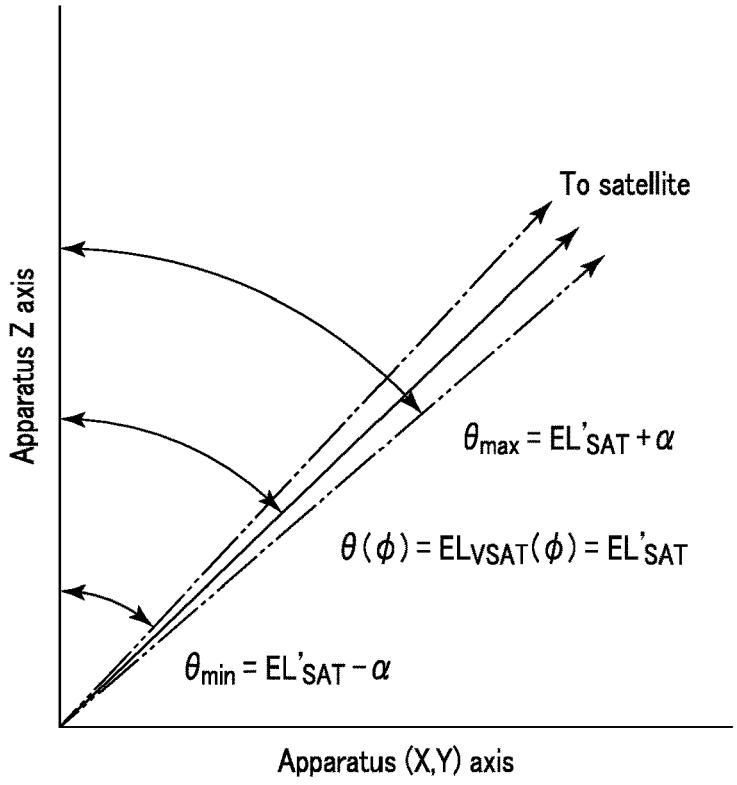
FIG. 5 is a schematic diagram showing that a polarization axis fluctuates along with rotation of an antenna 10 around an azimuth axis in a case where the satellite communication apparatus 1 is installed in an inclined state.

FIG. 5 is a schematic diagram showing that the polarization axis vector V fluctuates along with the rotation of the antenna 10 around the azimuth axis in a case where the satellite communication apparatus 1 is installed in an inclined state. As shown in FIG. 5, an angle θ formed by the apparatus coordinate system Z axis and the polarization axis vector V changes within a range of $\theta_{min}$ to $\theta_{max}$ as the antenna 10 rotates around the azimuth axis (the double-dotted chain line in the figure). Thus, e is expressed as θ=θ (φ) as a function of an azimuth angle φ of the antenna 10.

In addition, an antenna elevation angle (hereinafter, referred to as "apparatus reference elevation angle") of the satellite communication apparatus 1 is set as $EL_{VSAT}$ (φ). An angle (hereinafter, referred to as "earth reference elevation angle") formed by the earth coordinate system z axis and the polarization axis vector V is set as $EL'_{SAT}$. At this time, φ where θ (φ)=$EL_{VSAT}$ (φ)=$EL'_{SAT}$ exists. The minimum value and the maximum value of 0 are represented as $\theta_{min}=EL'_{SAT}-\alpha$ and $\theta_{max}=EL'_{SAT}+\alpha$, respectively, using a constant α.

Figure 6A:
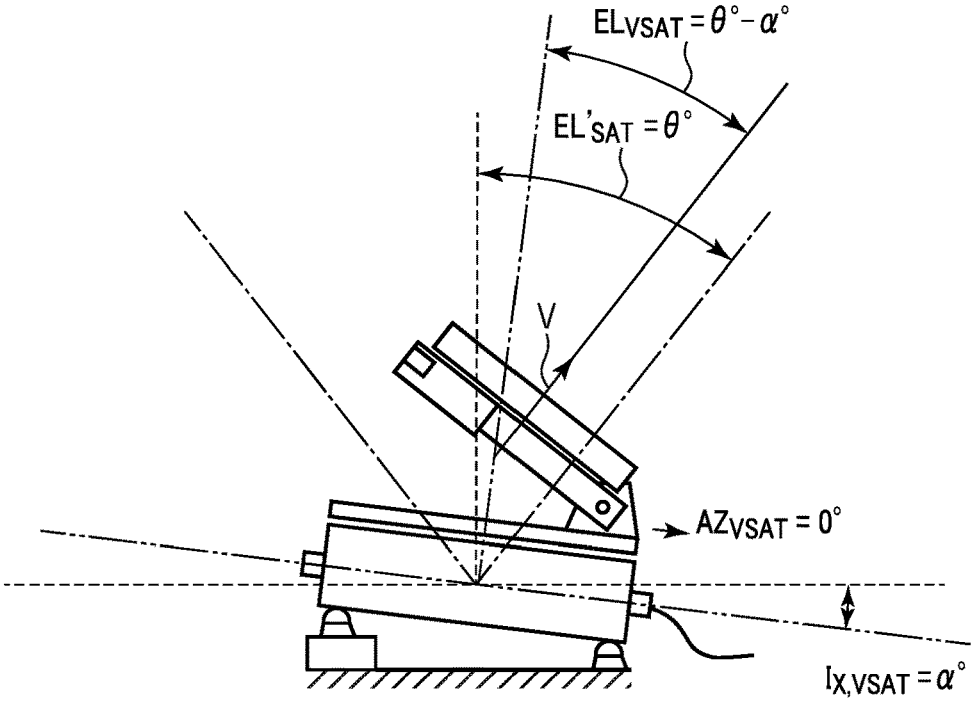
FIG. 6A is a diagram for explaining a change in the polarization axis vector V in a case where the satellite communication apparatus 1 is installed in an inclined state with respect to an X axis.
Figure 6B:
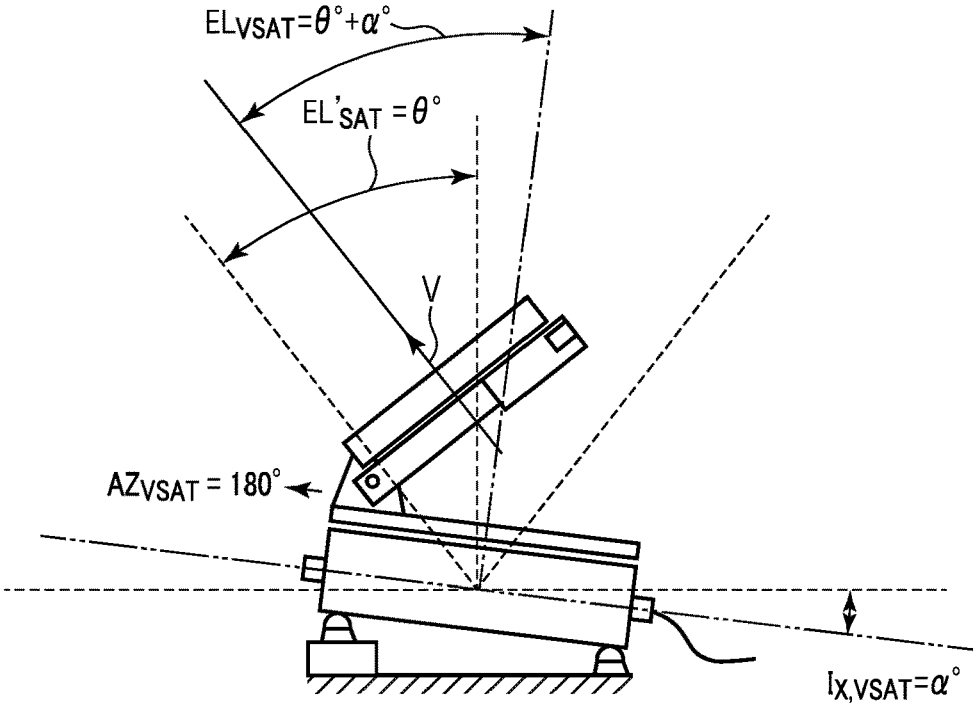
FIG. 6B is a diagram for explaining a change in the polarization axis vector V in the case where the satellite communication apparatus 1 is installed in an inclined state with respect to the X axis.

FIGS. 6A and 6B are diagrams for explaining a change in the polarization axis vector V in a case where the satellite communication apparatus 1 is installed in an inclined state with respect to the X axis (a horizontal direction with respect to the antenna surface). In the figures, dotted lines indicate the earth coordinate system, and a horizontal dotted line is the x axis and a perpendicular dotted line indicates the earth coordinate system z axis. Double-dotted chain lines indicate the apparatus X axis, and an angle $I_{X,VSAT}$ formed by the X axis and the x axis is set as an inclination angle α ($I_{X,VSAT}=\alpha°$).

FIG. 6A indicates a state in which the azimuth angle φ of the antenna 10 is 0° ($AZ_{VSAT}=0°$). In this state, if the earth reference elevation angle $EL'_{SAT}$, which is an angle formed by the earth coordinate system z axis and the polarization axis vector V, is θ ($EL'_{SAT}=\theta$), the apparatus reference elevation angle $EL_{VSAT}$ is smaller than θ by the inclination angle α ($EL_{VSAT}=\theta-\alpha$). From this state, when the azimuth angle control motor 20*a* is driven (FIG. 2) to rotate the antenna 10 180° around the azimuth axis, the antenna 10 enters a state of FIG. 6B.

FIG. 6B shows a state in which the azimuth angle φ of the antenna 10 is 180° ($AZ_{VSAT}=180°$). As compared with FIG. 6A, the antenna aperture faces the exactly opposite direction. Thus, the apparatus reference elevation angle $EL_{VSAT}$ is larger than the earth reference elevation angle $EL'_{SAT}$ by the inclination angle α ($EL_{VSAT}=\theta+\alpha$).

Here, $EL'_{SAT}=90°-EL_{SAT}$. The elevation angle EL ($EL_{SAT}$) of the communication satellite SAT is an angle formed by the horizontal axis and the communication satellite SAT.

Figure 7A:
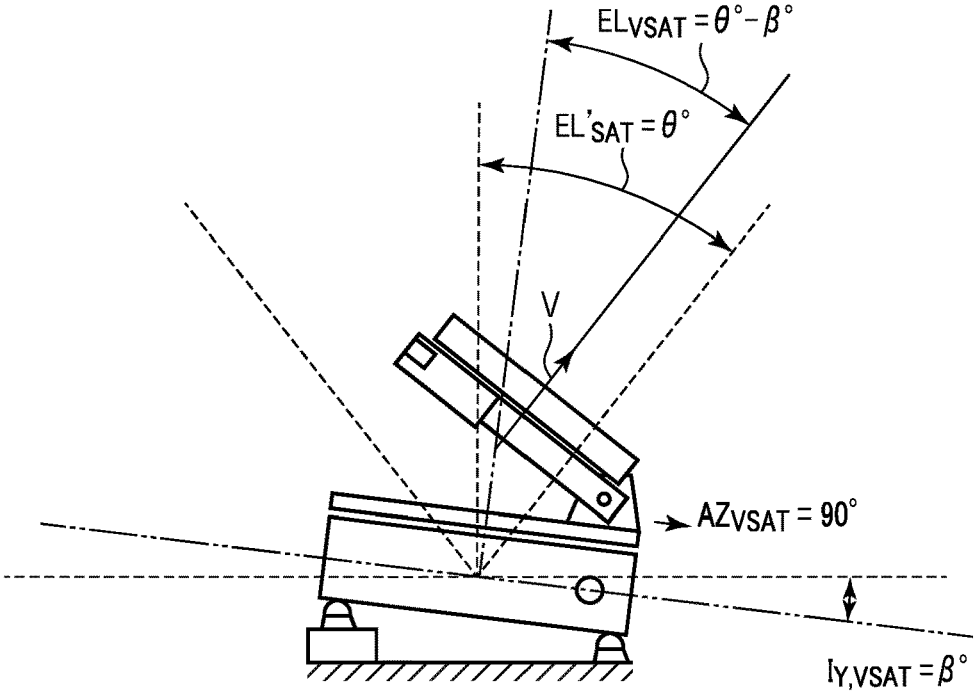
FIG. 7A is a diagram for explaining a change in the polarization axis vector V in a case where the satellite communication apparatus 1 is installed in an inclined state with respect to a Y axis.
Figures 7B, 8:
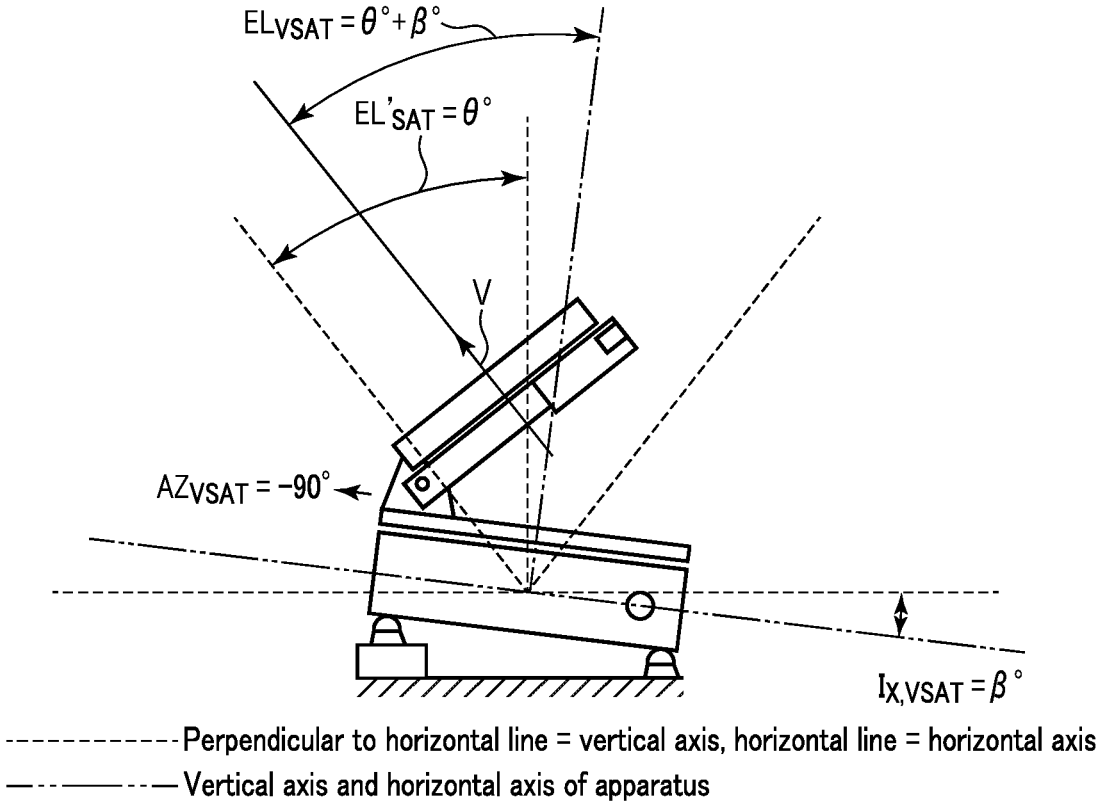
FIG. 7B is a diagram for explaining a change in the polarization axis vector V in the case where the satellite communication apparatus 1 is installed in an inclined state with respect to the Y axis.
FIG. 8 is a diagram showing a relationship between an antenna azimuth angle $AZ_{VSAT}$ and an antenna elevation angle $EL_{VSAT}$.

FIGS. 7A and 7B are diagrams for explaining a change in the polarization axis vector V in a case where the satellite communication apparatus 1 is installed in an inclined state with respect to the Y axis (the elevation angle direction with respect to the antenna surface). An angle $I_{Y,VSAT}$ formed by the Y axis and the y axis is set as an inclination angle β ($I_{Y,VSAT}=\beta°$).

FIG. 7A shows a state in which the azimuth angle φ of the antenna 10 is 90° ($AZ_{VSAT}=90°$). In this state, the apparatus reference elevation angle $EL_{VSAT}$ is smaller than the earth reference elevation angle $EL'_{SAT}$ (=θ) by the inclination angle φ ($EL_{VSAT}=\theta-\beta$). From this state, when the azimuth angle control motor 20*a* is driven (FIG. 2) to rotate the antenna 10 180° around the azimuth axis, the antenna 10 enters a state of FIG. 7B.

FIG. 7B shows a state in which the azimuth angle φ of the antenna 10 is −90° (i.e., 270°) ($AZ_{VSAT}=-90°$). Since the antenna aperture faces the exactly opposite direction as compared with FIG. 7A, the apparatus reference elevation angle $EL_{VSAT}$ is larger than the earth reference elevation angle $EL'_{SAT}$ by the inclination angle φ ($EL_{VSAT}=\theta+\beta$). To summarize a relationship between $AZ_{VSAT}$. (azimuth angle) and the apparatus reference elevation angle $EL_{VSAT}$ in FIGS. 6A to 7B, a table in FIG. 8 is obtained.

FIG. 8 shows a relationship between the azimuth angle $AZ_{VSAT}$ and the apparatus reference elevation angle $EL_{VSAT}$ of the antenna. In FIG. 8, $I_X$ is a in FIGS. 6A and 6B, and $I_Y$ is φ in FIGS. 7A and 7B. When the relationship of FIG. 8 is turned into a linear algebraic three-dimension rotational expression with $I_X$ and $I_Y$ as parameters, expression (1) is obtained.

[Expression 1]

$$EL_{VSAT}(AZ_{VSAT}) = EL'_{SAT} - I_x\cos(AZ_{VSAT}) - I_y\sin(AZ_{VSAT}) \quad (1)$$

$$= EL'_{SAT} - \sqrt{I_x^2 + I_y^2} * \cos\left(AZ_{VSAT} - \tan^{-1}\frac{I_y}{I_x}\right) \quad (1')$$

The first term on the right side of expression (1) is $EL'_{SAT}=\theta$. The second term on the right side indicates correction of an inclination component with respect to the X axis. The third term on the right side indicates correction of an inclination component with respect to the Y axis. When expression (1) is represented by a polar coordinate system, expression (1') is obtained. Parameters when converting expression (1) into the polar coordinate system are indicated in expression (2).

[Expression 2]

$$\sqrt{I_x^2 + I_y^2}: \text{Degree of overall inclination} \quad (2)$$

$$\tan^{-1}\frac{I_y}{I_x}: \text{Parameter for phase shift}$$

Figure 9:
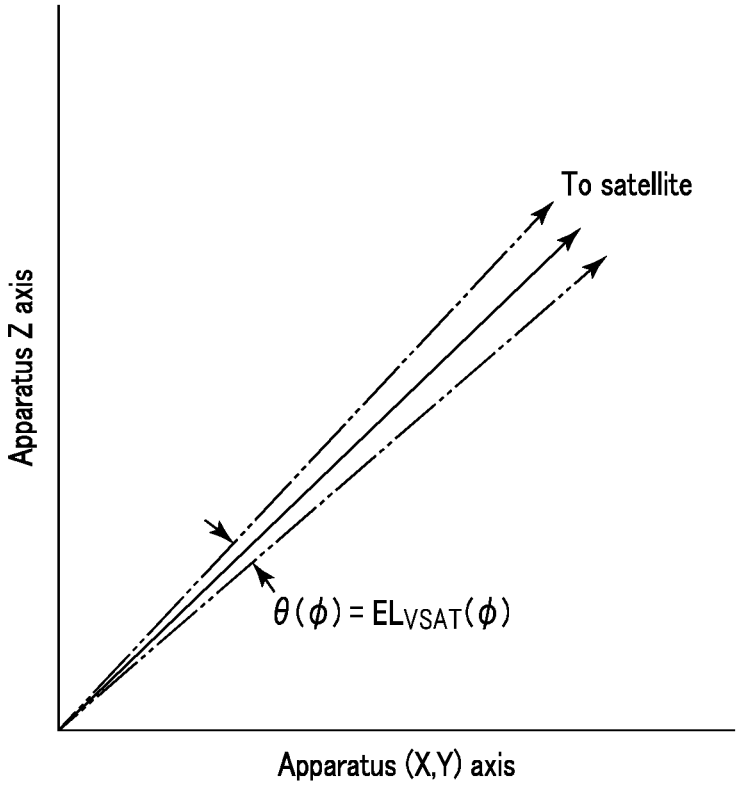
FIG. 9 is a diagram showing a change in the antenna elevation angle $EL_{VSAT}$ of the satellite communication apparatus 1 when $AZ_{VSAT}$ (=p) is changed within a range of 0° to 360° in equation (1)

FIG. 9 is a diagram showing a change in the apparatus reference elevation angle $EL_{VSAT}$ of the satellite communication apparatus 1 when $AZ_{VSAT}$ (=φ) is changed within a range of 0° to 360° in expression (1). That is, FIG. 9 provides a mathematical support for the schematic diagram of FIG. 5 by a simulation using expression (1). In FIG. 9, θ is a function of the azimuth angle φ, and φ is $AZ_{VSAT}$ of expressions (1) and (1'), and thereby the change in $EL_{VSAT}$ can be calculated.

Figure 10:
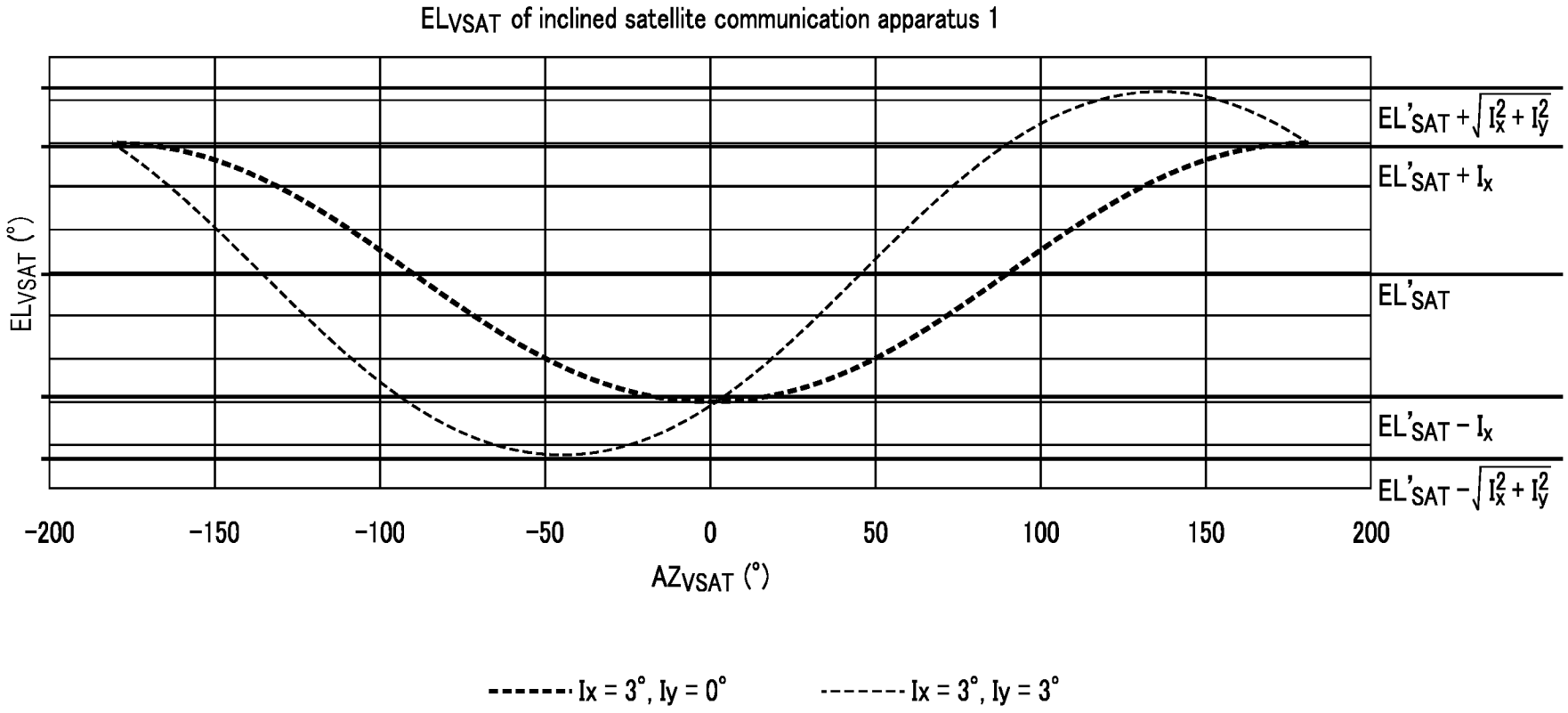
FIG. 10 is a graph plotting a change in the elevation angle $EL_{VSAT}$ by equation (1) with an azimuth angle φ ($AZ_{VSAT}$) as a horizontal axis.

FIG. 10 shows a graph plotting the change in the apparatus reference elevation angle $EL_{VSAT}$ by expression (1), with the azimuth angle φ ($AZ_{VSAT}$) as a horizontal axis. FIG. 10 shows a graph under two different conditions. In the figure, a thick dotted line indicates a calculation result under the condition of $I_X=3°$ and $I_Y=0°$. A thin dotted line indicates a calculation result under the condition of $I_X=3°$ and $I_Y=3°$. It can be understood that, as a degree of overall inclination indicated in expression (2) increases, a change amount of the apparatus reference elevation angle $EL_{VSAT}$ increases.

Figure 11:
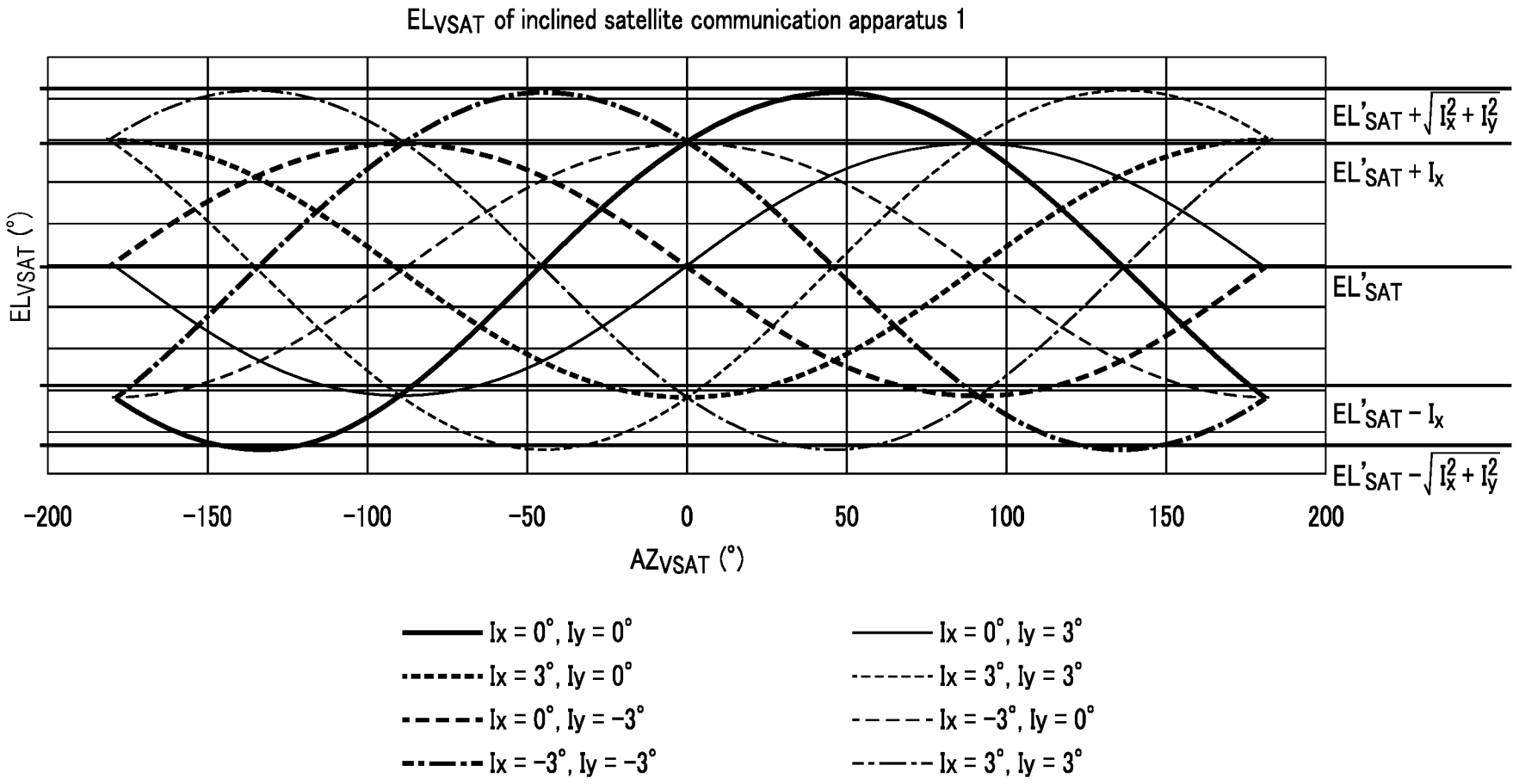
FIG. 11 shows a graph plotting a change in the elevation angle $EL_{VSAT}$ by equation (1) with the azimuth angle φ ($AZ_{VSAT}$) as a horizontal axis.

FIG. 11 is a diagram plotting curved lines under more various conditions. FIG. 11 shows that when the inclination of the apparatus changes, only the waveform amplitude and phase change.

When the azimuth angle φ ($AZ_{VSAT}$), which is a variable of expression (1), is represented as a function of time t, expression (3) is obtained.

[Expression 3]

$$EL_{VSAT}(AZ_{VSAT}(t)) = EL'_{SAT} - \sqrt{I_x^2 + I_y^2} * \cos\left(AZ_{VSAT}(t) - \tan^{-1}\frac{I_y}{I_x}\right) \quad (3)$$

When expression (3) is differentiated by time, expression (4) is obtained. Expression (4) indicates a change in rotation speed of the elevation angle control motor 20*b*.

[Expression 4]

$$\frac{d}{dt}(EL_{VSAT}(AZ_{VSAT}(t))) = \sqrt{I_x^2 + I_y^2} * \sin\left(AZ_{VSAT}(r) - \tan^{-1}\frac{I_y}{I_x}\right) \quad (4)$$

Figure 12:
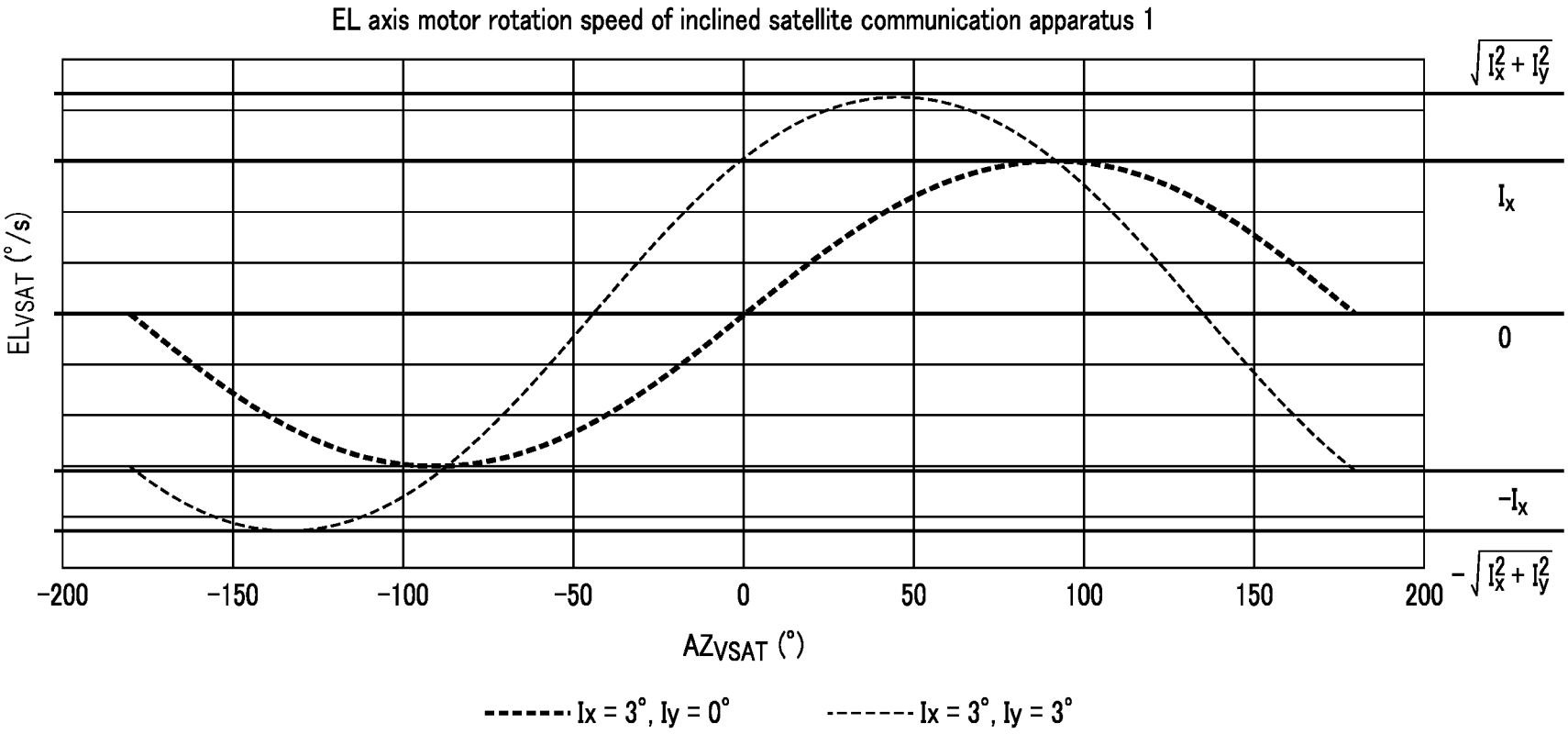
FIG. 12 shows a graph plotting a rotation speed of an elevation angle control motor 20*b* with respect to the azimuth angle φ ($AZ_{VSAT}$)

FIG. 12 is a graph plotting the rotation speed of the elevation angle control motor 20*b* with respect to the azimuth angle ($AZ_{VSAT}$). Conditions shown in FIG. 12 are the same as those of FIG. 10, where a thick dotted line indicates a calculation result under the condition of $I_X$=3° and $I_Y$=0°, and a thin dotted line indicates a calculation result under the condition of $I_X$=3° and $I_Y$=3°. Since expression (3) is differentiated by time, a curved line in each graph of FIG. 12 describes a sine curve (sine wave). That is, since the rotation speed of the elevation angle control motor 20*b* changes in a sine-wave shape, a signal for controlling the rotation speed of the motor needs to be changed in a sine-wave shape. For example, when a motor speed is controlled according to a pulse duty ratio, it requires a lot of calculations to change the pulse duty ratio smoothly and computer resources might be consumed excessively.

In the embodiment, therefore, the correction part 40*a* calculates the rotation speed of the elevation angle control motor 20*b* based on a value of the elevation angle calculated using expressions (1) to (3) that is sampled at a plurality of points. That is, the correction part 40*a* samples values of some points along a curved line (e.g., the graphs of FIGS. 10 and 11) indicating a change in the apparatus reference elevation angle $EL_{VSAT}$ with respect to the azimuth angle φ, and calculates the rotation speed of the elevation angle control motor 20*b* from the values.

Figure 13:
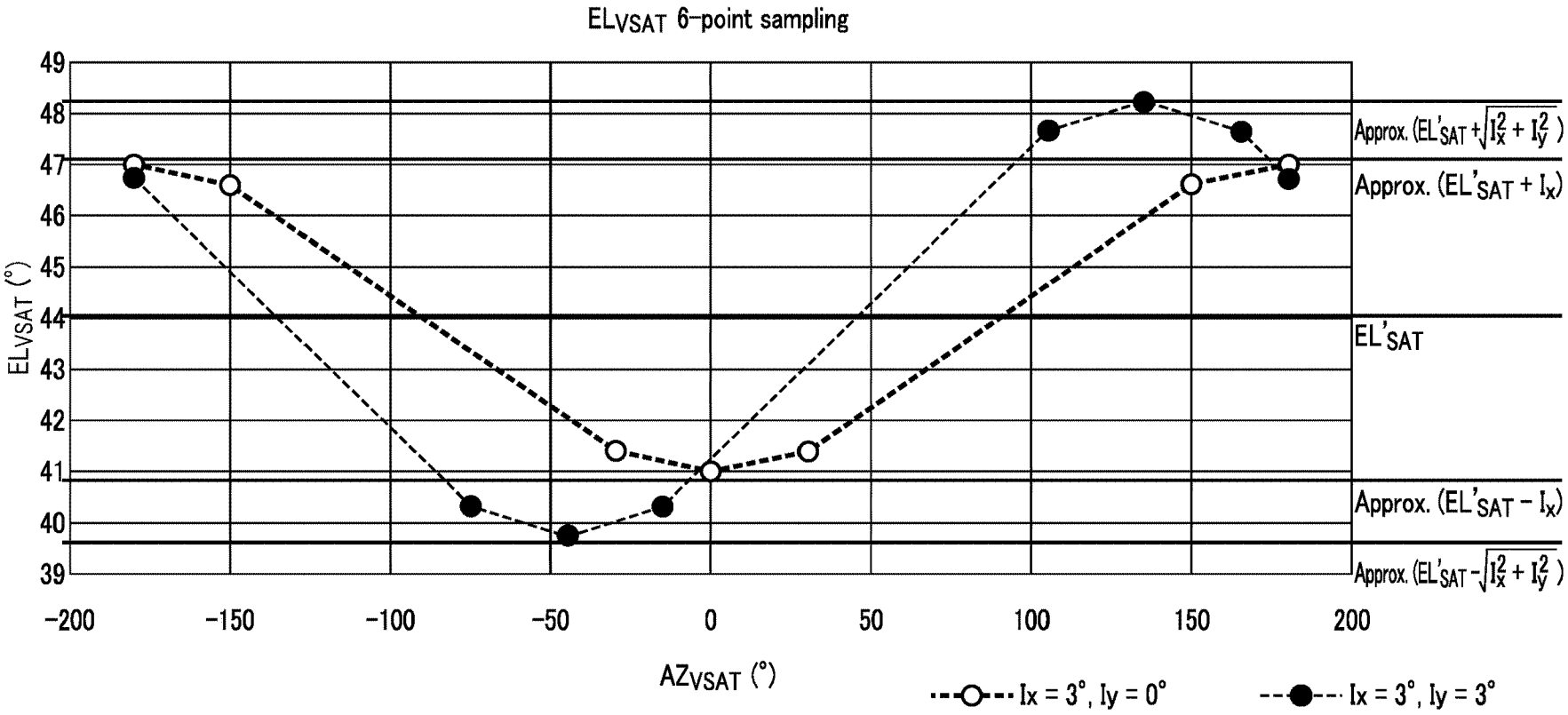
FIG. 13 is a diagram showing an example in which six points are sampled from the graph shown in FIG. 10.

FIG. 13 is a diagram showing an example in which six points are sampled from the graph of FIG. 10. In FIG. 13, a minimal value and a maximal value of the graph are sampled, and further, values of two points on the right and left of the minimal value and two points on the right and left of the maximal value, i.e., six points in total, are sampled. In the figure, black points indicate sampling points of the curved line of $I_X$=3° and $I_Y$=0°, and white points indicate sampling points of the curved line of $I_X$=3° and $I_Y$=3°.

Figure 14:
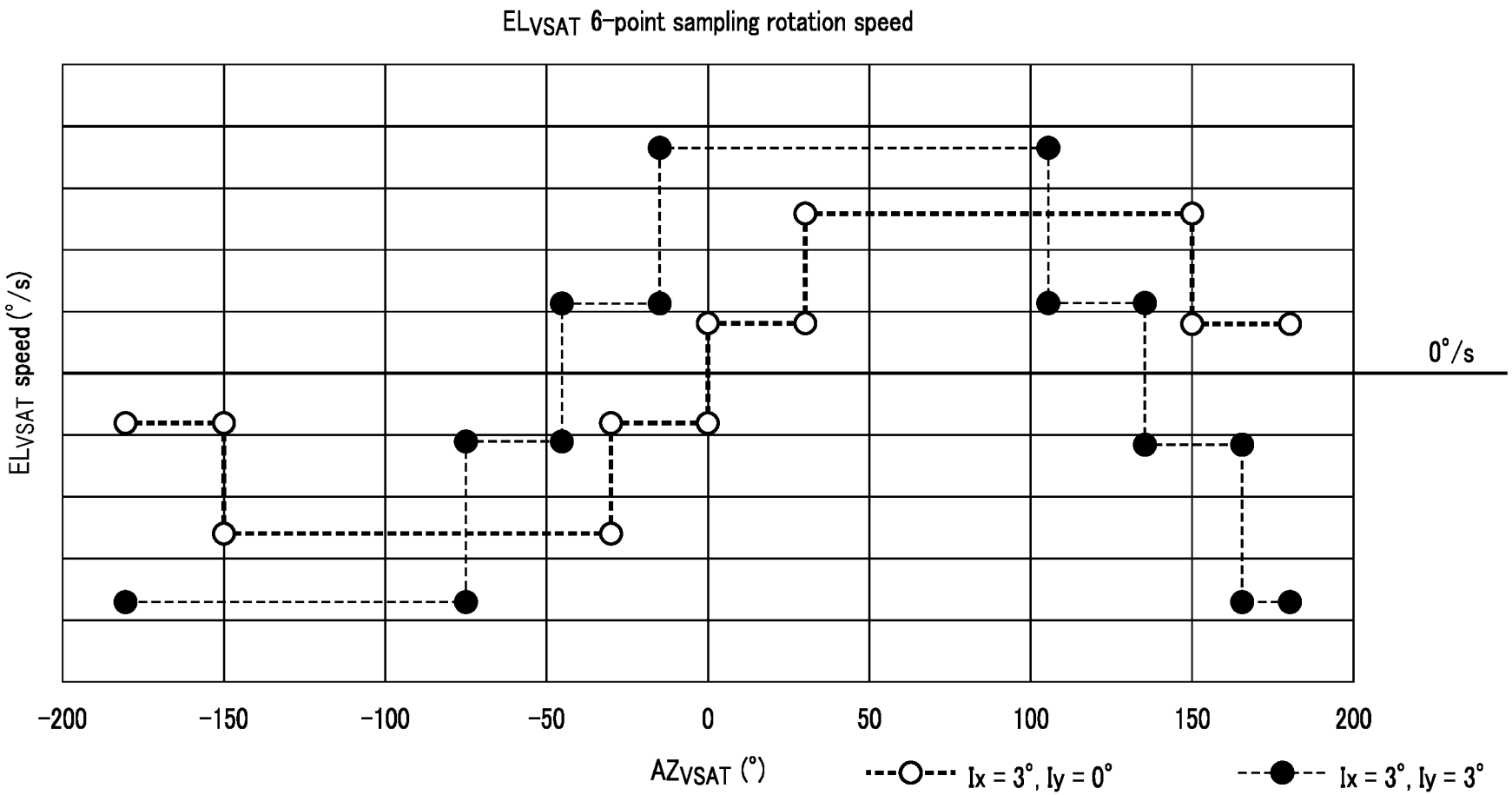
FIG. 14 is a diagram showing an example in which the rotation speed of the elevation angle control motor 20*b* with respect to the azimuth angle φ ($AZ_{VSAT}$) is sampled.

FIG. 14 is a diagram showing the rotation speed of the elevation angle control motor 20*b* obtained by the sampling results of FIG. 13. Under each of the conditions, the rotation speed shows a four-step stepwise shape, but can be considered to generally follow the curved line of FIG. 12. Expression (5) indicates the rotation speed of the elevation angle control motor 20*b* obtained by the sampling. The subscript "$_{now}$" of expression (5) indicates a current value, and "next" indicates the next value (a value in an increasing direction of the horizontal axis). Note that a rotation speed $AZ_{motor\ speed}$ of the azimuth angle control motor 20*a* can be a discretionary value in the settings in the software.

[Expression 5]

$$EL \text{ motor speed} = \frac{EL_{next} - EL_{now}}{\left(\frac{AZ_{next} - AZ_{now}}{AZ_{motor\ speed}}\right)} \quad (5)$$

Since a control amount is only 4 steps as shown in FIG. 14, the circuit of the azimuth angle motor controller (AZ) 30*a*, elevation angle motor controller (EL) 30*b*, and polarization angle motor controller (POL) 30*c* can be greatly simplified. As a result, required resources such as memory and processor speed can be saved to reduce the cost.

FIG. 15 is a diagram showing expressions for obtaining the six points in FIG. 13. As shown in FIG. 15, values at positions of, for example, 30° to the right and left from each of the minimal value and the maximal value may be sampled. Note that expression (6) indicating the first point becomes expression (7) when the phase changes 360°. Thus, a value of the first point and a value of the sixth point may be replaced as appropriate.

[Expression 6]

$$\tan^{-1}\frac{I_y}{I_x} \quad (6)$$

$$\frac{-I_y}{I_x} = \frac{I_y}{-I_x} \quad (7)$$

Figure 16:
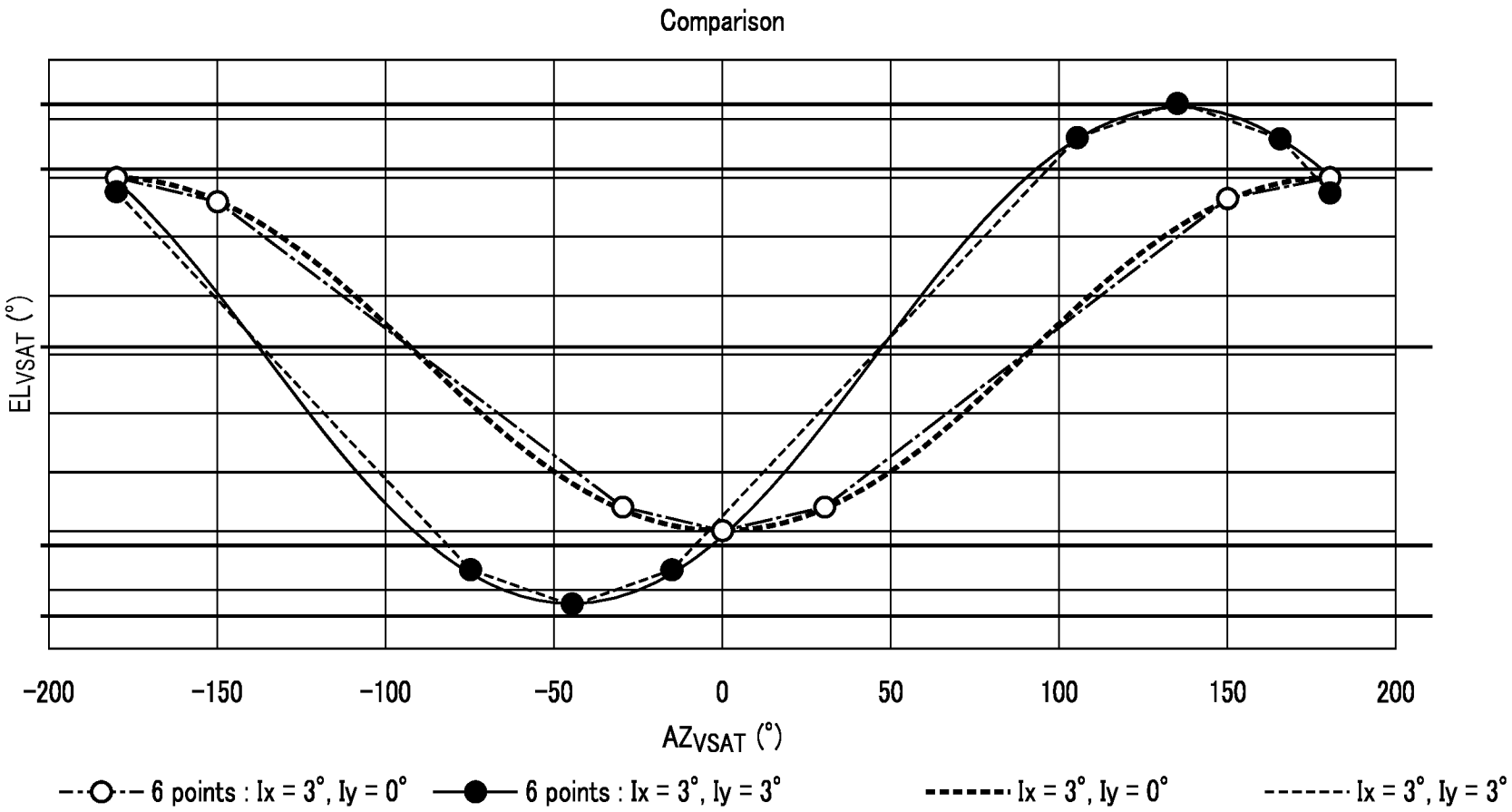
FIG. 16 is a diagram showing a comparison between a locus described by the six-point sampling and a sine curve.

FIG. 16 is a diagram showing a comparison between the straight lines connecting the sampling points and the sine curves. That is, FIG. 16 is a graph plotting the graph of FIG. 10 and the graph of FIG. 13 on the same scale.

Figure 17:
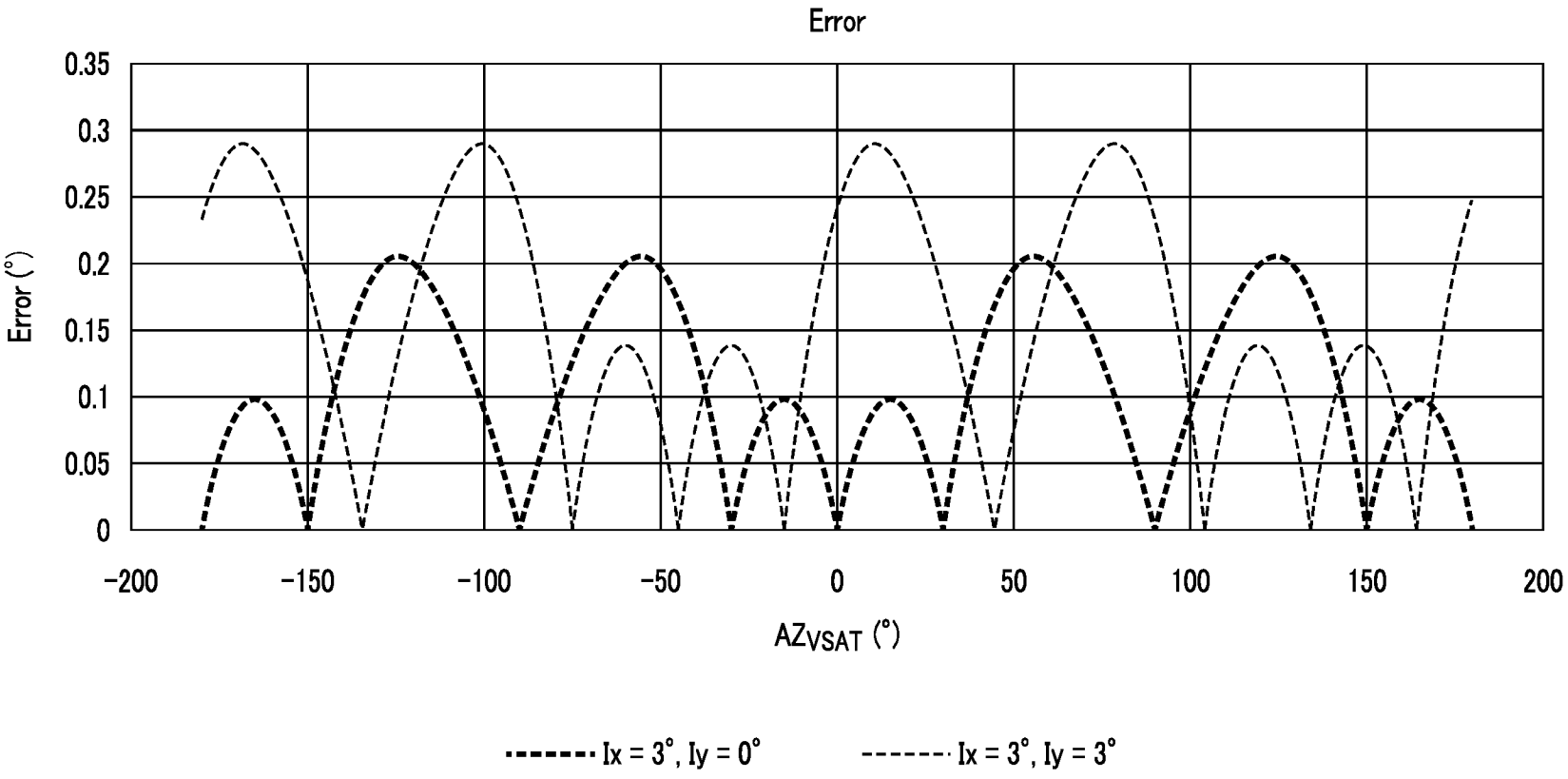
FIG. 17 is a diagram showing a graph plotting errors between the straight line and the sine curve in FIG. 16.

FIG. 17 is a diagram showing a graph plotting errors between the straight lines and the sine curves in FIG. 16. According to FIG. 17, it is indicated that an error under the condition of $I_X$=3° and $I_Y$=3° fluctuates more greatly than an error under the condition of $I_X$=3° and $I_Y$=0°. However, since it is indicated that the maximum value of the error is less than 0.3° at most, sufficient accuracy as an engineering control amount has been obtained. In general, it is sufficient if an error of 1° or less can be achieved. Naturally, the larger the number of sampling points, the higher the accuracy. Thus, the appropriate number of sampling points may be determined according to the computer resources that are implementable in the apparatus.

As described above, in the embodiment, when a 360° search is performed in the azimuth angle direction in the acquiring mode of the satellite communication apparatus 1, the inclination of the satellite communication apparatus 1 is measured by the inclination sensor 71 to obtain the inclination information. Then, based on the inclination information, expressions for calculating the simplified apparatus reference elevation angle ($EL_{VSAT}$) are derived from the linear algebraic three-dimension rotational expressions as indicated in expressions (1) to (3). Furthermore, by the simplification to the six-point sampling algorithm, the restriction on software implementation is relaxed so as to securely acquire the communication satellite SAT with the minimum resources.

That is, a target angle ($EL_{SAT}$) of the communication satellite SAT to be acquired is determined from the location information of the satellite communication apparatus 1. Then, the apparatus reference elevation angle ($EL_{VSAT}$) is controlled so as to always have the same elevation angle with respect to the communication satellite SAT regardless of the azimuth angle so that a 360° search can be performed while correcting the inclination of the satellite communication apparatus 1. According to the embodiment, therefore, it is possible to provide the satellite signal acquiring apparatus and method capable of acquiring the communication satellite SAT without resort to the azimuth sensor.

The programs for realizing the satellite communication apparatus 1 may be recorded in a computer-readable recording medium. In this case, a computer system reads the programs recorded in the recording medium and executes them to realize the image processing. The term "computer system" used herein may include an operating system (OS) or hardware such as a peripheral device.

The computer-readable recording medium is a recordable nonvolatile memory (such as a flexible disk, a magnetooptical disk, a ROM or a flash memory), a portable medium (such as a CD-ROM), or a hard disk built in in a computer system.

Furthermore, a computer-readable recording medium may be any type of storage capable of storing programs for a certain length of time, including a server to which programs are transmitted by way of a network (such as the Internet) or a communication channel (such as a telephone channel), and a volatile memory of a computer system serving as a client (such as a dynamic random access memory (DRAM)).

The programs may be transmitted from a computer system incorporating a storage in which they are stored to another computer system, by way of a transmission medium or by use of a carrier wave for the transmission medium. The "transition medium" used herein is intended to refer to a medium capable of transmitting information, including a network (communication network) such as the Internet or a communication channel such as a telephone channel.

The term "processor" used in the above explanations indicates, for example, a central processing unit (CPU), a Graphics Processing Unit (GPU), or circuits such as an Application Specific Integrated Circuit (ASIC), a Programmable Logic Device (for example, a Simple Programmable Logic Device (SPLD), a Complex Programmable Logic Device (CPLD), or a Field Programmable Gate Array (FPGA)).

The processor reads the programs stored in the storage circuit and executes them to realize the respective functions. The programs may be incorporated in the circuit of the processor, instead of storing them in the storage circuit. In this case, the processor reads the programs incorporated in its circuit and executes them to realize the respective functions. The processors described in connection with the above embodiment are not limited to single-circuit processors. A plurality of independent processors may be combined and integrated as one processor having multiple functions. Furthermore, a plurality of structural elements of the above embodiment may be integrated as one processor having multiple functions.

While certain embodiments have been described, these embodiments have been presented by way of example only, and are not intended to limit the scope. Indeed, the novel embodiments described herein may be embodied in a variety of other forms; furthermore, various omissions, substitutions and changes in the form of the embodiments described herein may be made without departing from the spirit. The accompanying claims and their equivalents are intended to cover such forms or modifications as would fall within the scope and spirit.

The invention claimed is:

1. A satellite signal acquiring apparatus, comprising:

an antenna configured to receive a radio wave from a communication satellite;

an azimuth angle control motor configured to rotate the antenna in an azimuth angle direction in an acquiring mode acquiring the communication satellite signal;

an elevation angle control motor configured to change an elevation angle of the antenna;

a main body equipped with the antenna, the azimuth angle control motor, and the elevation angle control motor;

an inclination sensor configured to obtain inclination information of the main body; and at least one processor, wherein the processor is configured to:

correct the elevation angle based on the inclination information to hold the elevation angle of the antenna in an earth coordinate system constant regardless of an azimuth angle of the antenna; and acquire the communication satellite signal based on reception intensity of the radio wave in the acquiring mode.

2. The satellite signal acquiring apparatus of claim 1, wherein the elevation angle of the antenna in the earth coordinate system is a target angle of a communication satellite to be acquired, the target angle corresponding to location information on the ground.

3. The satellite signal acquiring apparatus of claim 1, wherein the processor is further configured to:

calculate the elevation angle of the antenna that corresponds to a rotation angle of the antenna in the azimuth angle direction based on the inclination information.

4. The satellite signal acquiring apparatus of claim 3, wherein the processor is further configured to:

calculate a rotation speed of the elevation angle control motor that corresponds to the calculated elevation angle.

5. The satellite signal acquiring apparatus of claim 4, wherein the processor is further configured to:

calculate the rotation speed of the elevation angle control motor based on a value of the calculated elevation angle that is sampled at a plurality of points.

6. The satellite signal acquiring apparatus of claim 5, wherein the processor is further configured to:

sample the value of the elevation angle along a curved line described by the calculated elevation angle with respect to the rotation angle.

7. The satellite signal acquiring apparatus of claim 6, wherein the processor is further configured to:

when the curved line is a sine curve, sample six points near a peak of the sine curve.

8. A satellite signal acquiring method applicable to an apparatus comprising an antenna configured to receive a radio wave from a communication satellite, the method comprising:

rotating, by a computer of the apparatus, the antenna configured to receive the radio wave from the communication satellite in an azimuth angle direction by an azimuth angle control motor in an acquiring mode acquiring the communication satellite signal;

changing, by the computer, an elevation angle of the antenna by an elevation angle control motor;

obtaining, by the computer, inclination information of a main body equipped with the antenna, the azimuth angle control motor, and the elevation angle control motor by an inclination sensor;

correcting, by the computer, the elevation angle of the antenna based on the inclination information to hold the elevation angle in an earth coordinate system constant regardless of the azimuth angle of the antenna; and acquiring, by the computer, the communication satellite signal based on reception intensity of the radio wave in the acquiring mode.

* * * * *